US010472209B2

(12) United States Patent
Dube et al.

(10) Patent No.: US 10,472,209 B2
(45) Date of Patent: Nov. 12, 2019

(54) ELEVATOR OVERSPEED GOVERNOR WITH AUTOMATIC RESET

(71) Applicant: OTIS ELEVATOR COMPANY, Farmington, CT (US)

(72) Inventors: Randall S. Dube, Glastonbury, CT (US); Aayush Desai, New Britain, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 310 days.

(21) Appl. No.: 15/398,358

(22) Filed: Jan. 4, 2017

(65) Prior Publication Data

US 2017/0190545 A1 Jul. 6, 2017

Related U.S. Application Data

(60) Provisional application No. 62/274,622, filed on Jan. 4, 2016.

(51) Int. Cl.
*B66B 5/04* (2006.01)
*B66B 5/24* (2006.01)

(52) U.S. Cl.
CPC ..... *B66B 5/044* (2013.01); *B66B 5/24* (2013.01)

(58) Field of Classification Search
CPC ..... B66B 5/044; B66B 5/24
See application file for complete search history.

(56) References Cited

U.S. PATENT DOCUMENTS 2,262,366 A * 11/1941 McCormick ..... B66B 5/044 192/147
5,183,979 A * 2/1993 Sheridan ..... B66B 5/04 187/280
5,565,660 A * 10/1996 Karner ..... B66B 5/044 187/276
6,186,281 B1 * 2/2001 Pietrzykowski ..... B66B 5/06 187/287
6,619,435 B1 * 9/2003 Watzke ..... B66B 5/04 187/350

(Continued)

FOREIGN PATENT DOCUMENTS

CN 100575233 C 12/2009
CN 103508291 A 1/2014

(Continued)

OTHER PUBLICATIONS

EP Communication; European Search Report; Application No. 17150311.3-1731; dated Jul. 10, 2017; pp. 1-10.

*Primary Examiner* — Michael A Riegelman
(74) *Attorney, Agent, or Firm* — Cantor Colburn LLP

(57) ABSTRACT

A governor assembly is provided including a sheave rotatably mounted on a shaft and a ratchet disc mounted on the shaft. Rotation of the ratchet disc is restricted. An overspeed assembly includes a swing jaw mounted to the sheave. The swing jaw is movable between a normal position and a tripped position. The swing jaw is biased into the tripped position. When the swing jaw is in the tripped position, rotation of the sheave in a first direction is restricted. A tripping lever is pivotally mounted to the sheave and is configured to cooperate with the swing jaw. Rotation of the sheave in a second, opposite direction is configured to automatically move the swing jaw against its bias to the normal position.

14 Claims, 13 Drawing Sheets

(56) References Cited

U.S. PATENT DOCUMENTS

| | | | | |
|---|---|---|---|---|
| 7,537,090 | B2 * | 5/2009 | Vantanen | B66B 5/04 187/286 |
| 7,575,099 | B2 * | 8/2009 | Oh | B66B 5/06 187/247 |
| 8,181,749 | B2 * | 5/2012 | Okada | B66B 5/044 187/287 |
| 8,453,799 | B2 * | 6/2013 | Muller | B66B 5/044 187/287 |
| 8,887,791 | B2 * | 11/2014 | Eiterman | G01M 99/008 160/305 |
| 2004/0262109 | A1 * | 12/2004 | Timtner | B66B 5/044 188/377 |
| 2012/0006630 | A1 * | 1/2012 | Wang | B66B 5/044 187/350 |
| 2017/0190545 | A1 * | 7/2017 | Dube | B66B 5/044 |
| 2018/0029828 | A1 * | 2/2018 | Shi | B66B 5/044 |
| 2018/0118515 | A1 * | 5/2018 | Shi | B66B 5/02 |

FOREIGN PATENT DOCUMENTS

| | | | |
|---|---|---|---|
| CN | 203474151 | U | 3/2014 |
| CN | 104773628 | A | 7/2015 |
| EP | 1598300 | A1 | 11/2005 |
| EP | 2020396 | A1 | 2/2009 |
| EP | 2380839 | A1 | 10/2011 |
| EP | 2437996 | A2 | 4/2012 |
| GB | 2179795 | A | 3/1987 |
| KR | 20060109193 | A | 10/2006 |

* cited by examiner

ELEVATOR OVERSPEED GOVERNOR WITH AUTOMATIC RESET

CROSS REFERENCE TO RELATED APPLICATIONS

This application claims the benefit of Provisional Application No. 62/274,622, filed Jan. 4, 2016, the contents of which is incorporated by reference in its entirety herein.

BACKGROUND OF THE DISCLOSURE

This disclosure generally relates to the elevator system, and more particularly, to a centrifugally actuated governor that reacts to a speed of the elevator car or counterweight.

A common challenge in elevator design is engineering safety systems to prevent or react to elevator malfunction. One such safety system is the speed governor. Elevator speed governors are designed to prevent elevator cars or counterweights from exceeding a set speed limit. The governor is a component in an automated safety system, which is actuated when the elevator car or counterweight exceeds a set speed and either signals a control system to stop the car or directly engages a safety linkage connected to the safeties to stop the car. One commonly known governor is a centrifugally actuated governor.

A common design of centrifugal governors used in elevator systems employs two masses, sometimes referred to as flyweights, connected kinematically in an opposing configuration by links and pinned to a tripping sheave rotating about a common axis. These interconnected parts create a governor mechanism, which rotates at an angular velocity common with the angular velocity of the sheave. The angular velocity of the rotating masses results in a centrifugal force acting to propel the masses away from the sheave axis of rotation. The movement of the masses is essentially a cantilevering motion radially outward about their pinned attachments to the sheave. A coupler prevents the radial outward movement of the masses up to a set elevator car speed. The coupler commonly includes a spring connected between the sheave and one of the masses, which resists the centrifugal force generated by the angular velocity of the rotating sheave up to a set speed. When the elevator car meets or exceeds a set speed limit, sometimes referred to as an overspeed condition, the governor is actuated. In the overspeed condition, the force of the governor coupler, for example the spring coupler, is overcome by the centrifugal force acting on the masses. The two masses move radially outward and commonly engage a sensor at a first speed, which in turn signals control logic in the elevator system to interrupt power to the elevator machine and release a brake to stop the elevator car. If this is ineffective, at a second higher set speed, movement of the masses enables a safety linkage to engage the safeties and stop the elevator car and/or counterweight.

Some existing elevator systems include a governor assembly having a separate swing jaw and tripping lever. However, these types of governor assemblies require that the tripping lever be manually reset by a mechanic in the field before the elevator system can be used after an overspeed condition requiring activation of the safety linkage to engage the safeties. In other existing elevator systems, the radial movement of the flyweights results in a swing jaw having an integrated tripping lever to approach and ultimately engage a tooth of an adjacent ratchet disc. However, the slow radial movement of the flyweights results in a slow rotation of the swing jaw towards the ratchet disc. As a result of this slow movement, the swing jaw may contact and deflect from an end of a tooth on the ratchet disc, thereby allowing the overspeed condition to continue until proper engagement between the swing jaw and the ratchet is achieved.

BRIEF DESCRIPTION

According to one embodiment of the disclosure, a governor assembly is provided including a sheave rotatably mounted on a shaft. An overspeed assembly includes a swing jaw mounted to the sheave. The swing jaw is movable between a normal position and a tripped position. The swing jaw is biased into the tripped position. When the swing jaw is in the tripped position, and therefore engaged with the ratchet disc, rotation of the sheave in a first direction is restricted by the limited allowed ratchet disc rotation. A tripping lever is pivotally mounted to the sheave and is configured to cooperate with the swing jaw. Rotation of the sheave in a second, opposite direction is configured to automatically move the swing jaw against its bias to the normal position.

In addition to one or more of the features described above, or as an alternative, in further embodiments a biasing mechanism extending between the sheave biases the swing jaw into the tripped position.

In addition to one or more of the features described above, or as an alternative, in further embodiments the swing jaw includes a shoulder and the tripping lever includes a protrusion. During normal operation, the protrusion is arranged in contact with the shoulder to oppose the bias of the swing jaw.

In addition to one or more of the features described above, or as an alternative, in further embodiments the swing jaw includes an engagement end. When the swing jaw is in the tripped position, the engagement end contacts the ratchet disc to restrict rotation of the sheave.

In addition to one or more of the features described above, or as an alternative, in further embodiments the engagement end includes a resetting feature and movement of the sheave in the second direction causes the resetting feature to contact a portion of the ratchet disc and rotate the swing jaw opposite its bias.

In addition to one or more of the features described above, or as an alternative, in further embodiments the resetting feature is a lip.

In addition to one or more of the features described above, or as an alternative, in further embodiments the resetting feature is a tooth having an angled surface.

In addition to one or more of the features described above, or as an alternative, in further embodiments the ratchet disc includes a contact member extending perpendicularly from a surface thereof. The contact member is configured to contact the resetting feature of the swing jaw.

In addition to one or more of the features described above, or as an alternative, in further embodiments the ratchet disc includes a plurality of teeth extending about a periphery of the ratchet disc.

In addition to one or more of the features described above, or as an alternative, in further embodiments comprising at least one flyweight mounted to the sheave and movable between a retracted position and an extended position.

In addition to one or more of the features described above, or as an alternative, in further embodiments the tripping lever is operably coupled to the at least one flyweight such that movement of the at least one flyweight to a deployed position causes the tripping lever to rotate out of contact with the swing jaw.

In addition to one or more of the features described above, or as an alternative, in further embodiments a biasing mechanism biases the flyweight to the retracted position. The biasing mechanism is configured to bias the tripping lever into engagement with the swing jaw.

In addition to one or more of the features described above, or as an alternative, in further embodiments comprising a remote tripping assembly operably coupled to the tripping lever, the remote tripping assembly being configured to rotate the tripping lever out of contact with the swing jaw.

In addition to one or more of the features described above, or as an alternative, in further embodiments the remote tripping assembly includes an actuator and a movable member operably connected to the actuator. Operation of the actuator moves the movable member relative to the tripping assembly.

According to another embodiment, an elevator system includes an elevator hoistway and an elevator car movable along at least one car guide rail within the hoistway. A counterweight is movable along at least one counterweight guide rail within the hoistway. A governor assembly includes a sheave rotatably mounted on a shaft and operably coupled to the elevator car. A ratchet disc is mounted to the shaft such that rotation of the ratchet disc is restricted. An overspeed assembly includes a swing jaw mounted to the sheave. The swing jaw is movable between a normal position and a tripped position. The swing jaw is biased into the tripped position. When the swing jaw is in the tripped position, and therefore engaged with the ratchet disc, rotation of the sheave in a first direction is restricted by the limited allowed ratchet disc rotation. A tripping lever is pivotally mounted to the sheave and is configured to cooperate with the swing jaw. Rotation of the sheave in a second, opposite direction is configured to automatically move the swing jaw against its bias to the normal position.

In addition to one or more of the features described above, or as an alternative, in further embodiments comprising at least one flyweight mounted to the sheave and movable between a retracted position and an extended position. The tripping lever is operably coupled to the at least one flyweight such that movement of the at least one flyweight to a deployed position causes the tripping lever to rotate out of contact with the swing jaw.

In addition to one or more of the features described above, or as an alternative, in further embodiments a biasing mechanism biases the flyweight to the retracted position such that the at least one flyweight moves to the deployed position when the centrifugal force of the sheave generated by the rotation of the sheave exceeds a biasing force of the biasing mechanism.

In addition to one or more of the features described above, or as an alternative, in further embodiments the swing jaw includes a resetting feature. A portion of the ratchet disc is configured to contact the resetting feature to rotate the swing jaw against its bias from the tripped position to the normal position.

According to another embodiment, a method of tripping an overspeed assembly of a governor assembly includes detecting an overspeed condition of a rotating sheave. A tripping lever is rotated out of contact with an adjacent swing jaw. The swing jaw is biased into contact with a ratchet disc capable of limited rotation.

In addition to one or more of the features described above, or as an alternative, in further embodiments comprising resetting the overspeed assembly. Resetting the overspeed assembly includes rotating the sheave relative to the ratchet disc such that a resetting feature of the swing jaw engages a portion of the ratchet disc, rotating the swing jaw against its bias, and arranging the tripping lever in contact with a portion of the swing jaw to oppose the bias of the swing jaw.

According to another embodiment, a method of remotely tripping an overspeed assembly of a governor assembly includes generating a signal to initiate a remote trip and applying power to an actuator. A tripping lever is contacted with a movable member operably coupled to the actuator to rotate the tripping lever out of contact with an adjacent swing jaw. The swing jaw is biased into contact with a ratchet disc capable of limited rotation.

BRIEF DESCRIPTION OF THE DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

The detailed description explains embodiments of the disclosure, together with advantages and features, by way of example with reference to the drawings.

DETAILED DESCRIPTION OF THE DISCLOSURE

Figure 1:
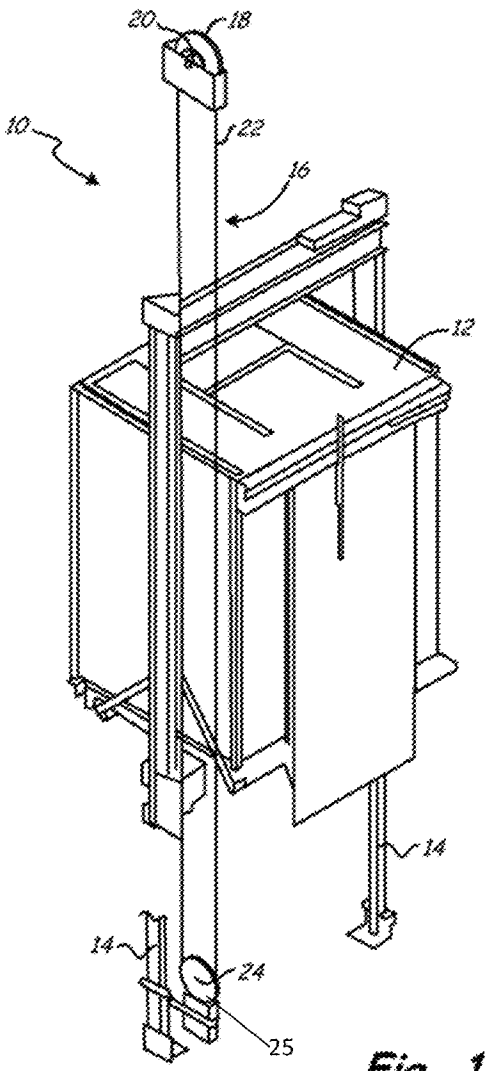
FIG. 1 is a perspective view of an example of an elevator system including a governor.

Referring now to FIG. 1, an elevator system 10 including an elevator car 12, guide rails 14, and a governor assembly 16 is illustrated. The governor assembly 16 includes a tripping sheave 18, a governor 20, a rope loop 22, and a rope tensioning assembly 24 including a tensioning sheave 25. The elevator car 12 travels on or is slidably connected to the guide rails 14 and travels inside a hoistway (not shown). The tripping sheave 18 and the governor 20 are mounted, in this embodiment, at an upper end of the hoistway. The rope loop 22 is wrapped partially around the tripping sheave 18 and partially around the tensioning sheave 25 (located in this embodiment at a bottom end of the hoistway). The rope loop 22 is also connected to the elevator car 12, ensuring that the angular velocity of the tripping sheave 18 is related to the speed of the elevator car 12.

In the elevator system 10 as shown in FIG. 1, the governor assembly 16 acts to prevent the elevator car 12 from exceeding a set speed as it travels inside the hoistway. Although the governor assembly 16 shown in FIG. 1 is mounted at an upper end of the hoistway, the location and arrangement of the governor assembly 16 may vary across different embodiments of the present invention. For example, the governor assembly 16 may be mounted at practically any point along the rope loop 22 in the hoistway, including at the bottom, i.e., pit, of the hoistway. In another embodiment, the governor assembly 16 may alternatively be mounted to and move with the elevator car 12. Such an alternative embodiment may, for example, involve a static rope anchored at the top and tensioned by a weight or an elastic member at bottom of the hoistway and wrapped partially around the tripping sheave 18 and an adjacent idler sheave.

Referring now to FIGS. 2-12, a partial view of the tripping sheave 18 is illustrated. Mounted to a side surface 26 of the tripping sheave 18 is at least one flyweight 28 pivotable about a pin (not shown). Most commonly, the tripping sheave 18 includes a plurality of flyweights 28 spaced equidistantly about the tripping sheave 18. In one embodiment, the flyweights 28 are operably coupled to one another by a linkage (not shown). The centrifugal force generated by the rotation of the tripping sheave 18 causes at least one fly weight 28 to pivot radially outwardly. A biasing mechanism, shown at 29 in FIGS. 6 and 7, such as a spring for example, is attached to each flyweight 28 and the tripping sheave 18 and is configured to act against the centrifugal force. Only when a rotational speed of the tripping sheave 18 exceeds a predetermined threshold will the centrifugal force overcome the bias of the biasing mechanism 29 causing the flyweight 28 to pivot to a deployed position.

An engagement or ratchet disc 30 which is rotatable relative to the tripping sheave 18 is mounted about the sheave shall 23. The ratchet disc 30 has a smaller diameter than the tripping sheave 18 and includes a plurality of teeth 32 disposed about the entire outer circumference thereof. During normal operating conditions, the ratchet disc 30 is decoupled from the rotation of the sheave shaft 23, such that the disc 30 remains generally stationary.

Figure 2:
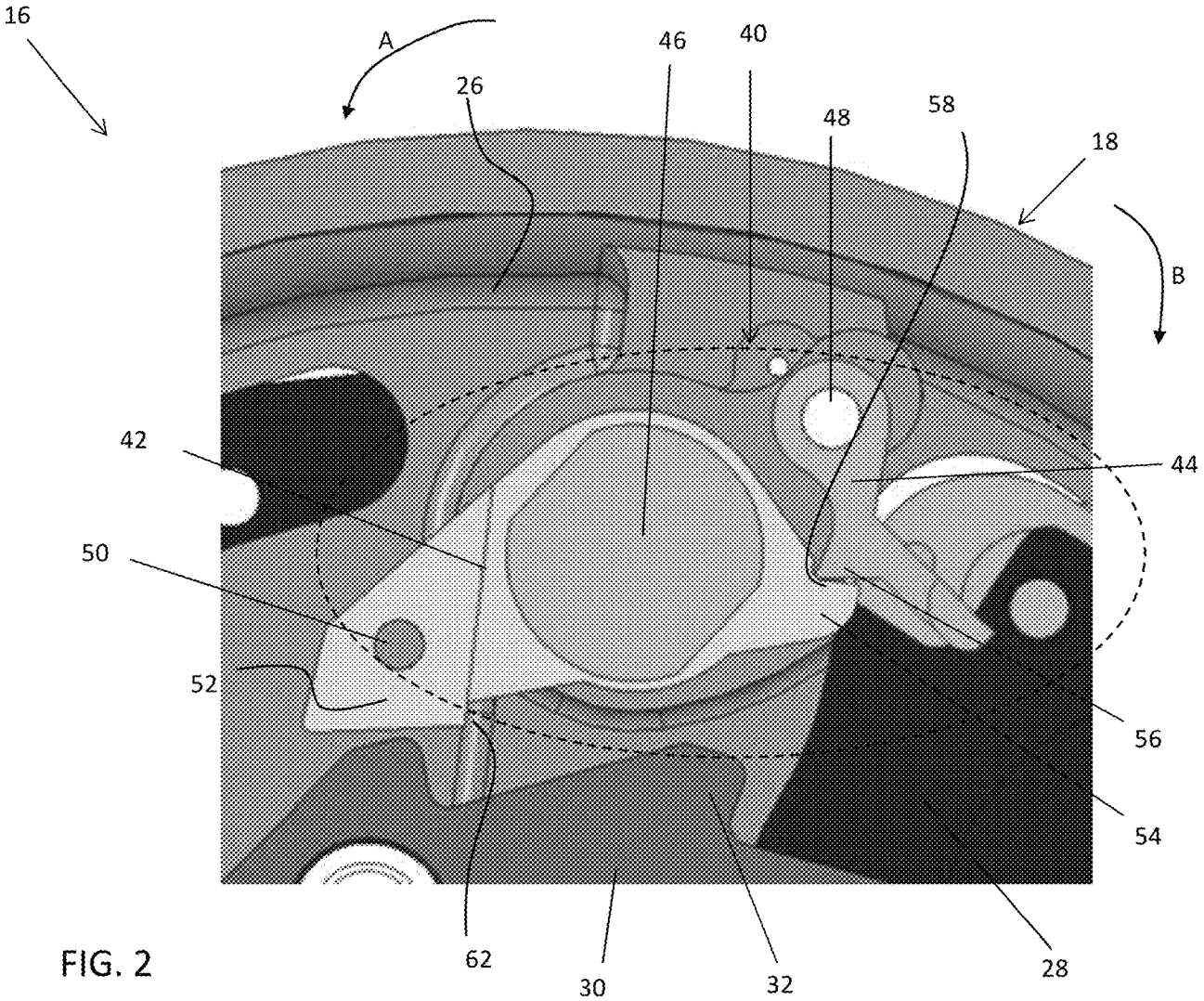
FIG. 2 is a front view of a tripping sheave and overspeed assembly in a normal position according to an embodiment.

The governor assembly 16 additionally includes an overspeed assembly 40 including a swing jaw 42 and a tripping lever 44 pivotally mounted to the side surface 26 of the tripping sheave 18. The swing jaw 42 is capable of rotating about a first pin 46 while the tripping lever 44 is rotatable about a second pin 48. The swing jaw 42 is biased by a biasing mechanism 50 (best shown in FIG. 10) towards a first position, in a direction indicated by arrow A (FIG. 2). The tripping lever 44 is operably coupled to at least one flyweight 28, such that the biasing mechanism 29 acting on the flyweight 28 biases the biasing mechanism towards a first position, in a direction indicated by arrow B (FIG. 2). In addition, pin 48 may include a biasing mechanism (not shown) similarly configured to bias the tripping lever 44 in the direction indicated by arrow B, into contact with the swing jaw 42.

The swing jaw 42 includes an engagement end 52 for contacting the ratchet disc 30. The engagement end 52 is arranged at a first side of the swing jaw 42 and a shoulder 54 additionally extends from a second, opposite side of the swing jaw 42. The tripping lever 44 includes a protrusion 56 configured to selectively cooperate with the shoulder 54 of the swing jaw 42.

With reference again to FIG. 2, the overspeed assembly 40 is illustrated during normal operation of the elevator system 10. As shown, the protrusion 56 of the tripping lever 44 is arranged in contact with an upper surface 58 of the shoulder 54 of the swing jaw 42. This contact counters the biasing force of the biasing mechanism 50 such that the engagement end 52 of the swing jaw 42 is disposed vertically above and out of contact with the teeth 32 of the ratchet disc 30. As a result, the tripping sheave 18 rotates freely with the movement of the elevator car 12.

Figure 3:
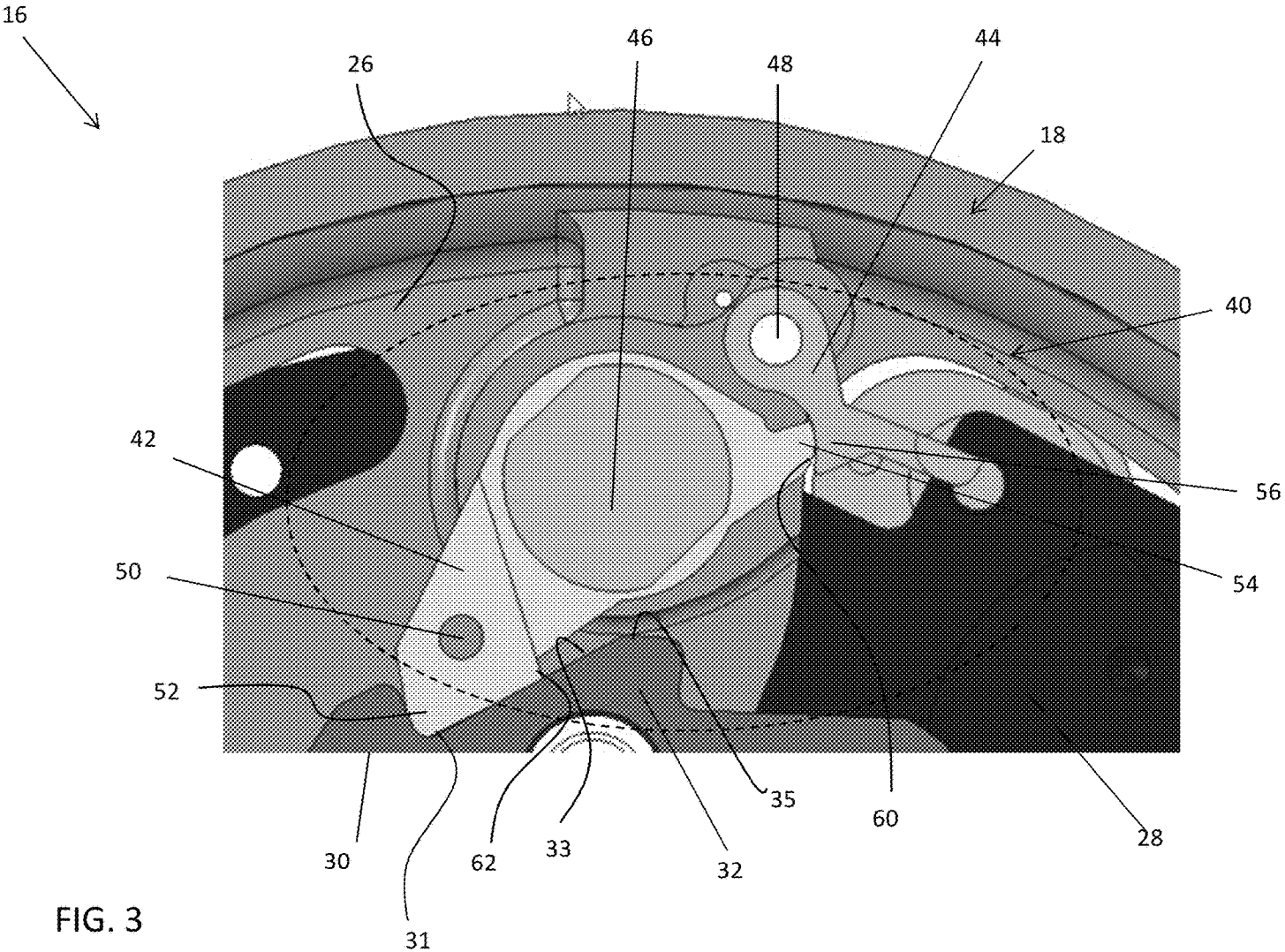
FIG. 3 is a front view of the overspeed assembly of FIG. 2 in a tripped position according to an embodiment.
Figure 4:
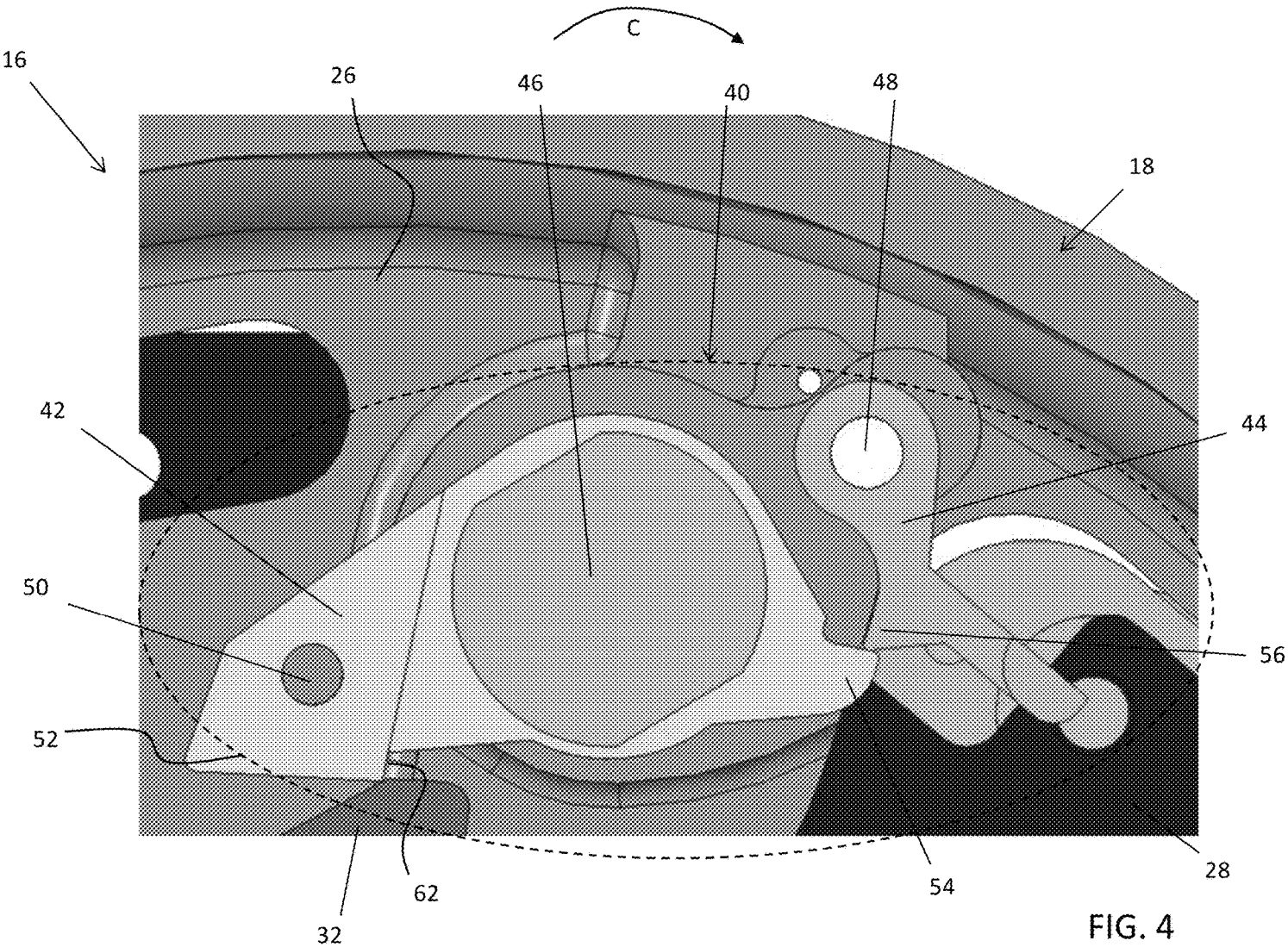
FIG. 4 is a front view of the overspeed assembly of FIG. 3 during a resetting operation according to an embodiment.
Figure 5:
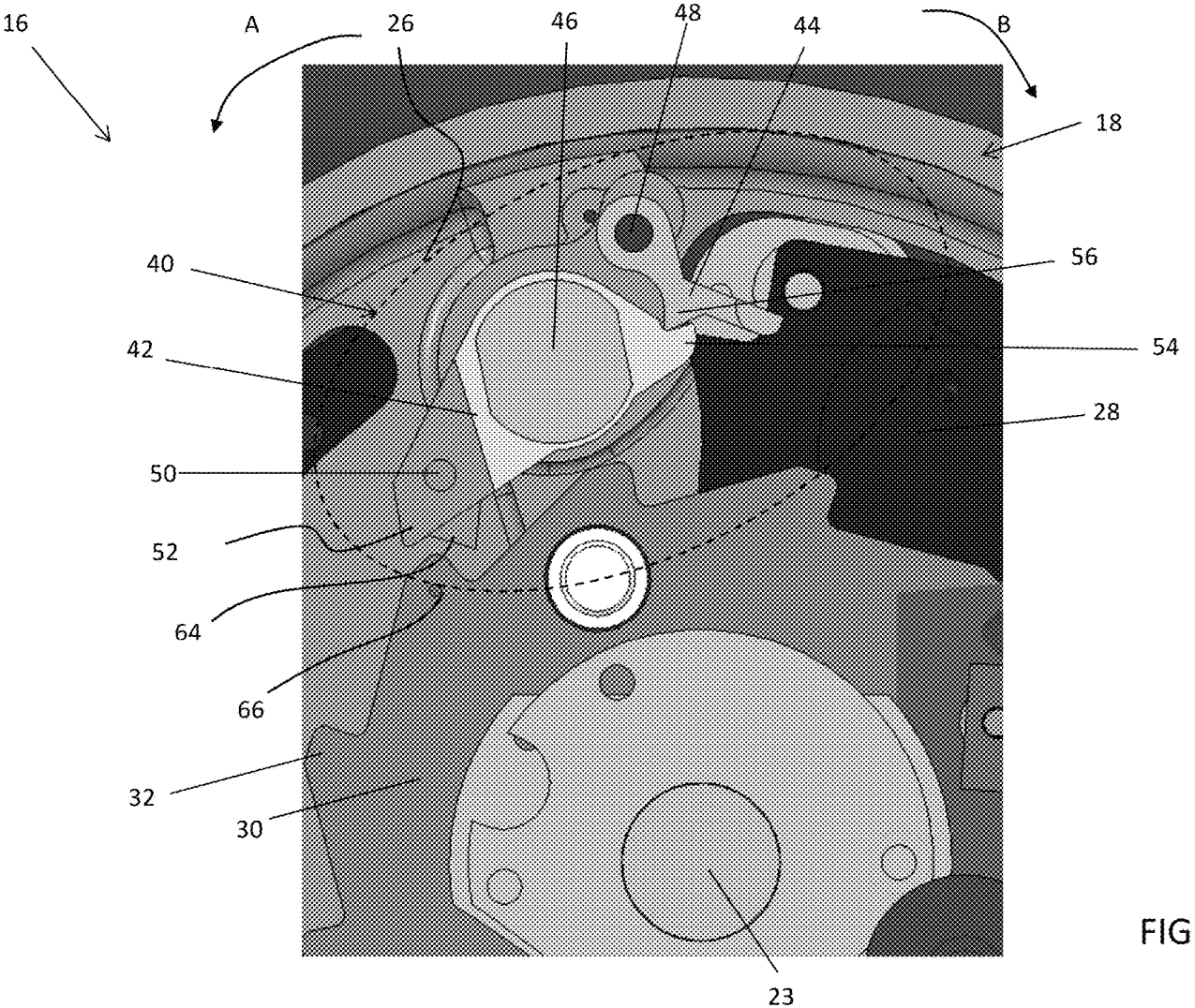
FIG. 5 is a front view of another tripping sheave and overspeed assembly in a normal position according to an embodiment.
Figure 6:
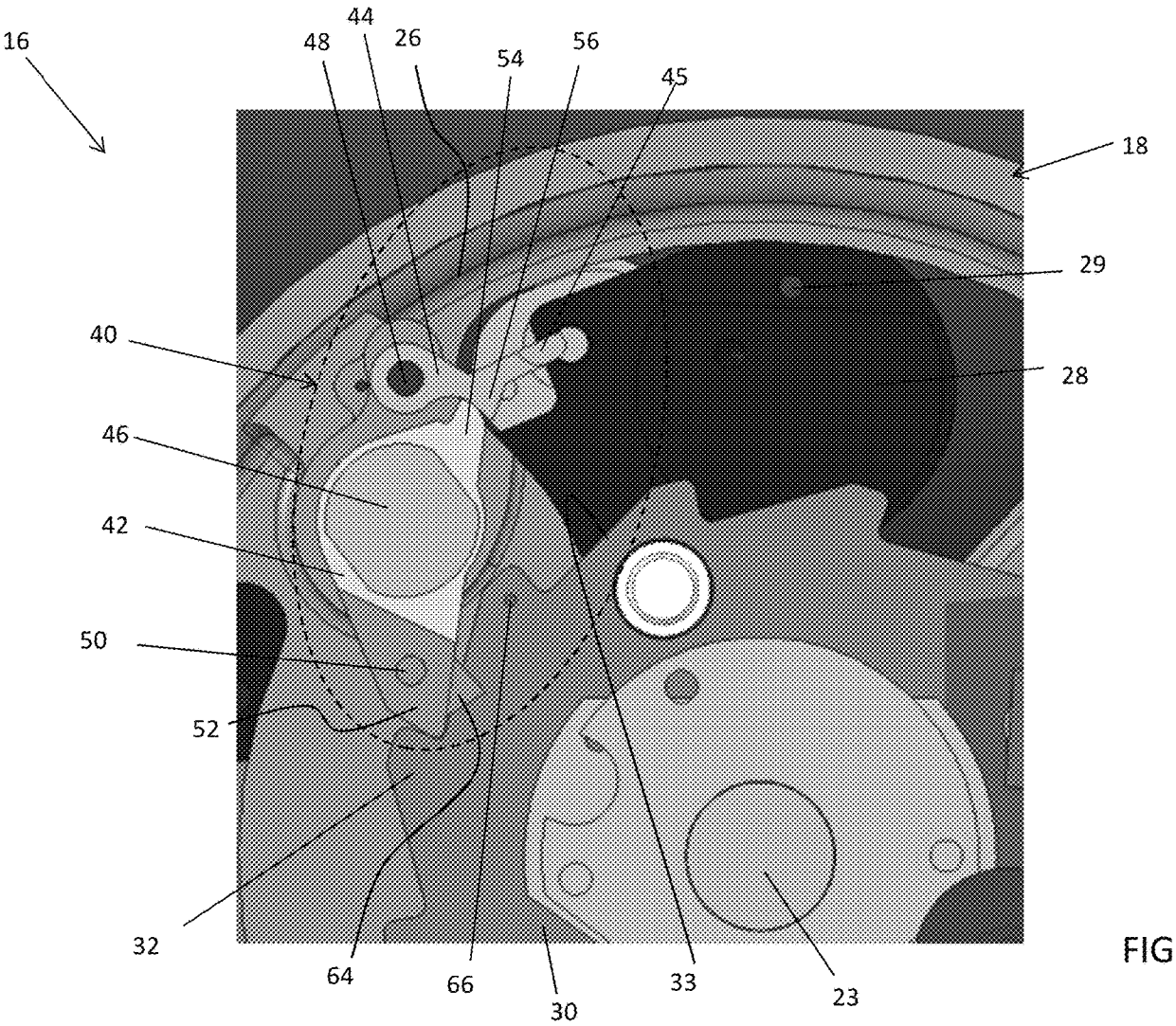
FIG. 6 is a front view of the overspeed assembly of FIG. 5 in a tripped position according to an embodiment.

Upon entering an overspeed condition, the centrifugal force acting on the flyweights 28 will overcome the biasing force of the biasing mechanism 29, such that the flyweights 28 pivot radially outward about their respective axes. This movement of the flyweights 28 causes the tripping lever 44 to pivot in a direction opposite a biasing force about pin 48, out of contact with the swing jaw 42. When the protrusion 56 is removed from the swing jaw 42, the biasing force of the biasing mechanism 50 causes the swing jaw 42 to pivot about pin 46 to a tripped position. In the tripped position, the engagement end 52 is arranged in contact with the most recessed surface 31 proximate adjacent teeth 32 of the ratchet disc 30 (FIG. 3). The biasing force of the biasing mechanism 50 is sufficient to drive the rotation of the swing jaw 42 with a desired force thereby creating deliberate and efficient contact between the engagement end 52 and the most recessed surface 31 proximate adjacent teeth 32 of the ratchet disc 30.

An example of the overspeed assembly 40 in the tripped position is illustrated in FIG. 3. The contact between the engagement end 52 and the ratchet disc 30 restricts rotation of the tripping sheave 18 and the sheave shaft 23. In addition, as can be seen from FIG. 3, when the swing jaw 42 is in the tripped position, the tripping lever 44 is biased towards the swing jaw 42 such that the protrusion 56 of the tripping lever 44 is arranged in contact with a second, bottom surface 60 of the shoulder 54.

When the swing jaw 42 is in the tripped position, opposite rotation of the sheave shaft 23 due to upward movement of the car 12, causes a similar rotation of the tripping sheave 18 and a similar, but restricted, annular rotation of the ratchet disc 30 about the axis of rotation. This rotation of the tripping sheave relative to the stationary ratchet disc 30 is configured to automatically reset the overspeed assembly 40.

As shown, as the tripping sheave 18 rotates, a resetting feature on the engagement end 52 of the swing jaw 42 contacts and engages a portion of the ratchet disc 30. In the non-limiting embodiment illustrated in FIGS. 2-4, the engagement end 52 includes a lip 62 extending vertically below an adjacent portion of the swing jaw 42. A portion of the lip 62 functions as the resetting feature. As a result, when the tripping sheave 18 is rotated in a direction indicated by arrow C (FIG. 4) relative to the ratchet disc 30 to reset the swing jaw 42, the engagement end 52 slidably engages a ramp like surface 33 of a ratchet tooth 32 until an end 35 of the ratchet tooth 32 contacts the lip 62 of the swing jaw 42.

Because rotation of the tripping sheave 18 is driven by movement of the elevator car 12, the rotational force of the tripping sheave 18 is sufficient to overcome the biasing force of the biasing mechanism 50. The contact with lip 62 causes the swing jaw 42 to rotate against the biasing force of the biasing mechanism 50, back to a normal position. As the swing jaw 42 is rotated by the tooth 32, the shoulder 54 of the swing jaw 42 applies a force to the protrusion 56 of the tripping lever 44 in a direction opposite the biasing force of the flyweight biasing mechanism 29. Once the shoulder 54 rotates out of engagement with the protrusion 56, the biasing force of the flyweight biasing mechanism 29 will cause the tripping lever 44 to pivot back to its normal position where the engagement between the protrusion 56 and an upper surface 58 of the shoulder 54 restricts rotation of the swing jaw 42 in the biasing direction.

Figure 7:
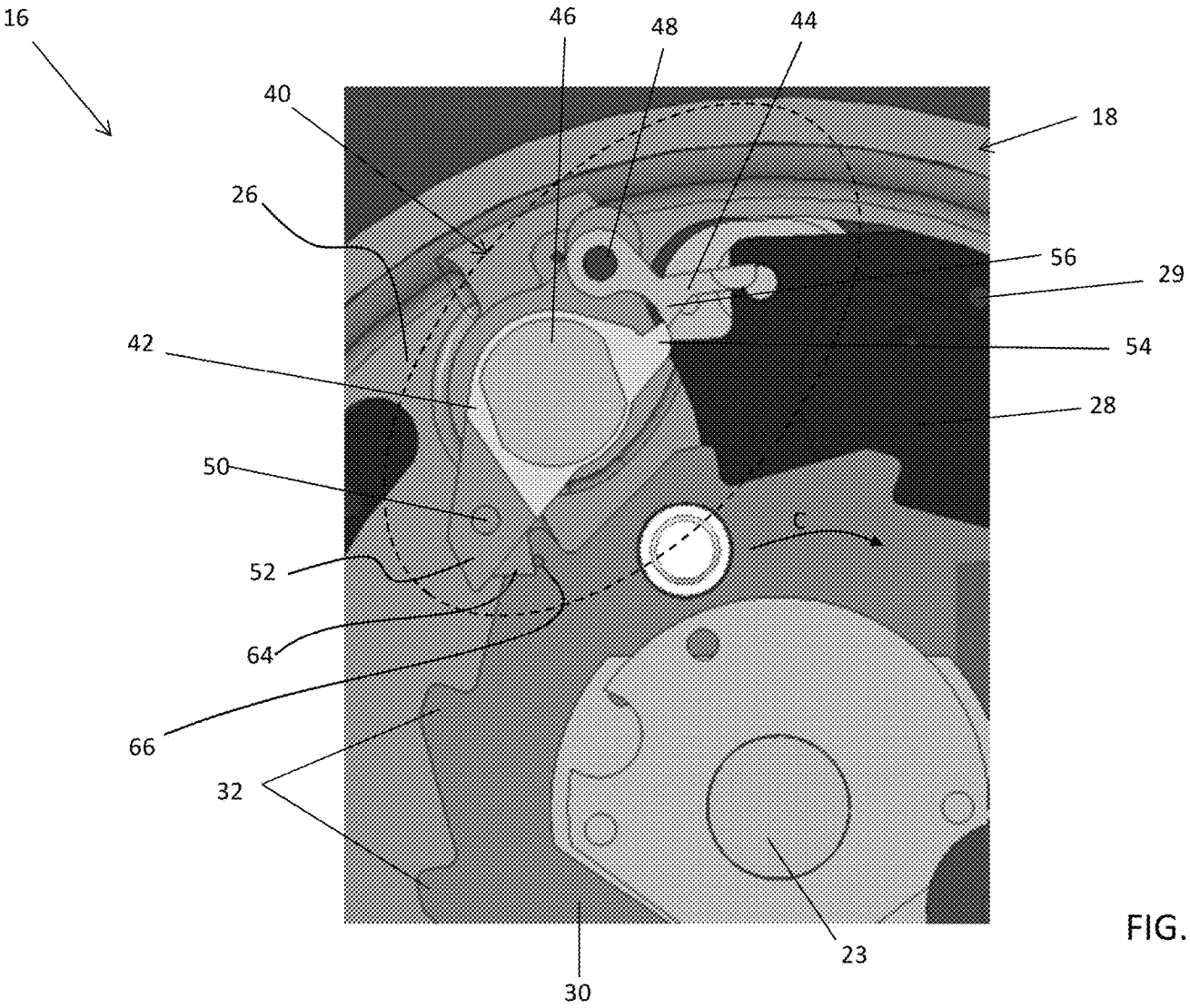
FIG. 7 is a front view of the overspeed assembly of FIG. 6 during a resetting operation according to an embodiment.
Figure 8:
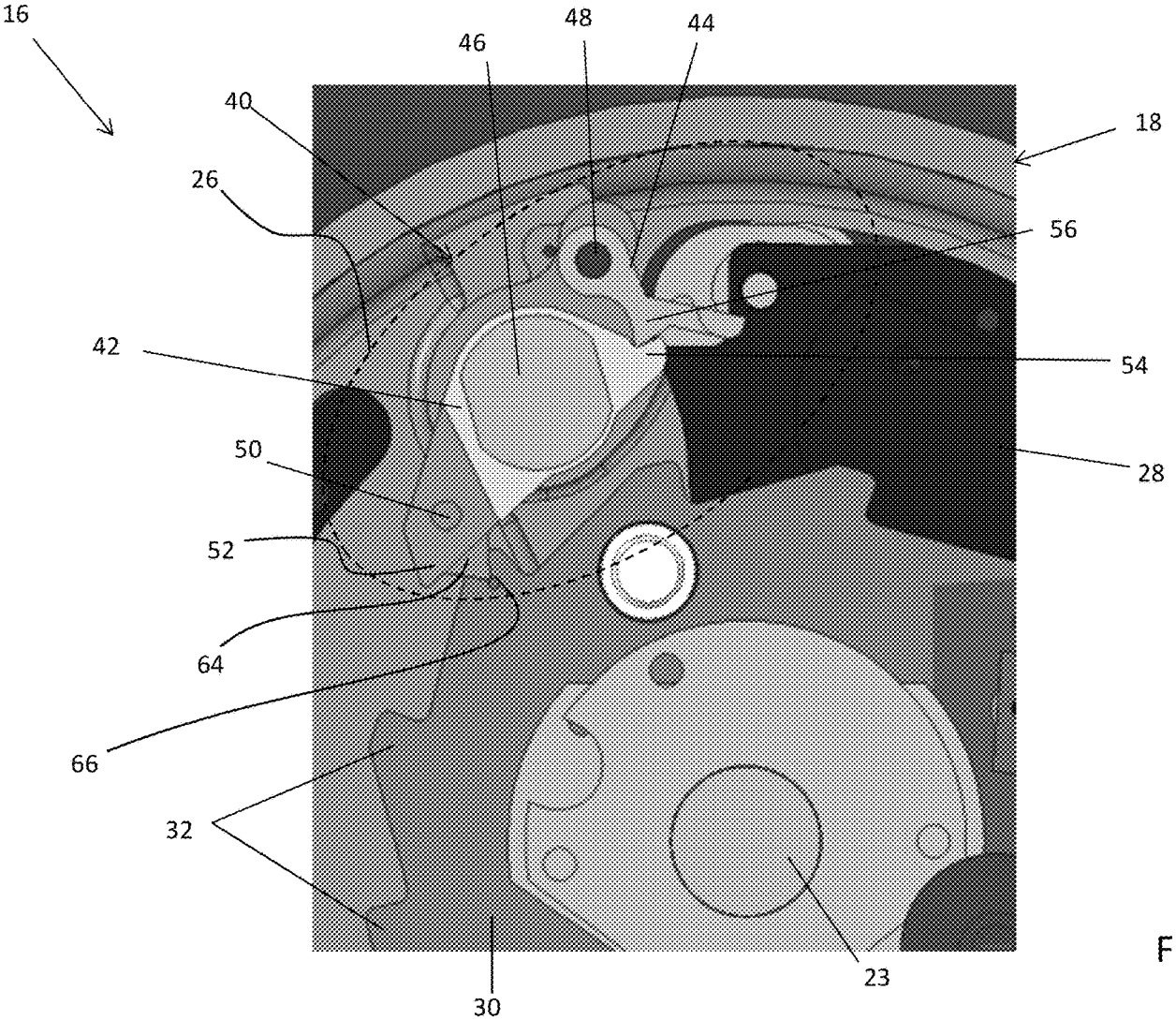
FIG. 8 is a front view of the overspeed assembly of FIG. 7 in a reset position according to an embodiment.
Figure 9:
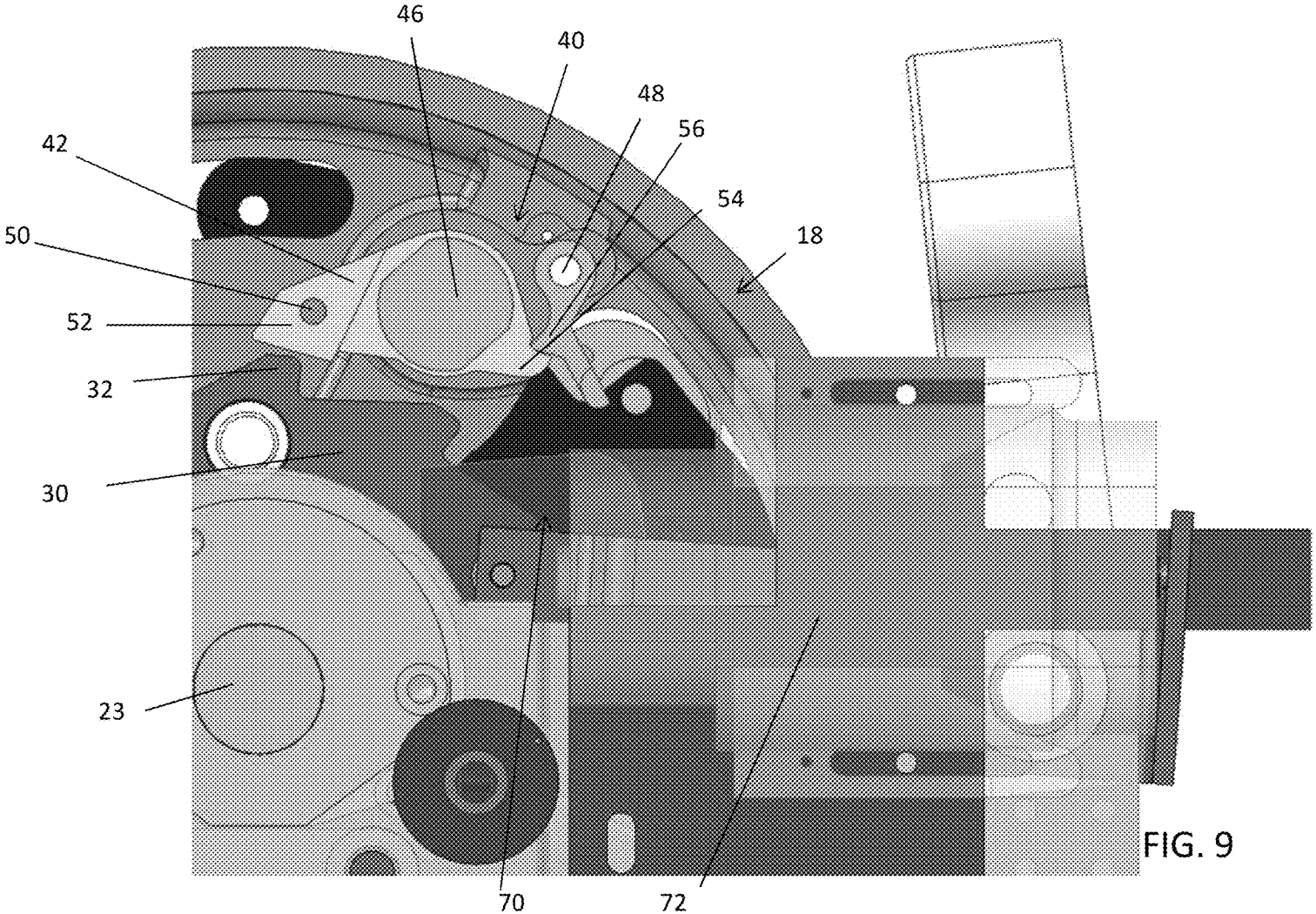
FIG. 9 is a front view of an overspeed assembly and a remote tripping assembly according to an embodiment.
Figure 10:
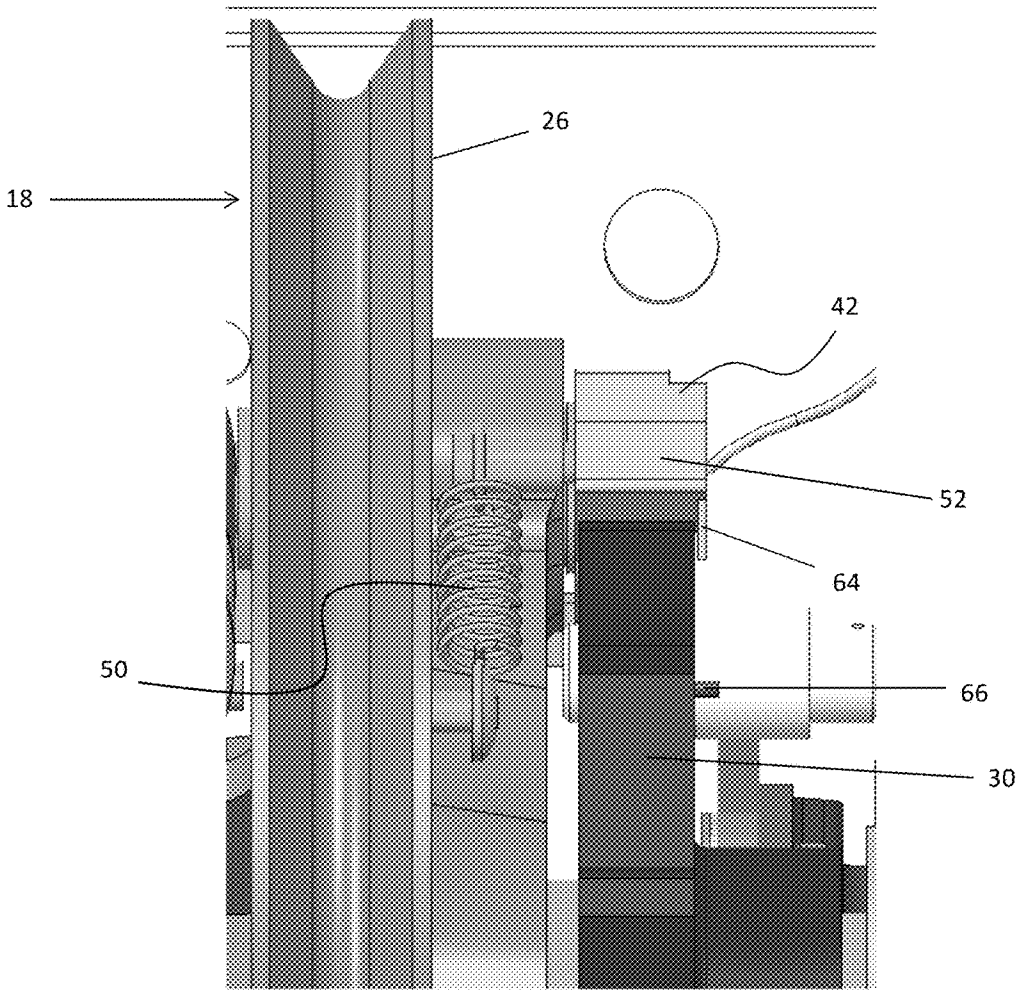
FIG. 10 is a side view of the overspeed assembly of FIGS. 2 and 5 and a remote tripping assembly according to an embodiment.
Figure 11:
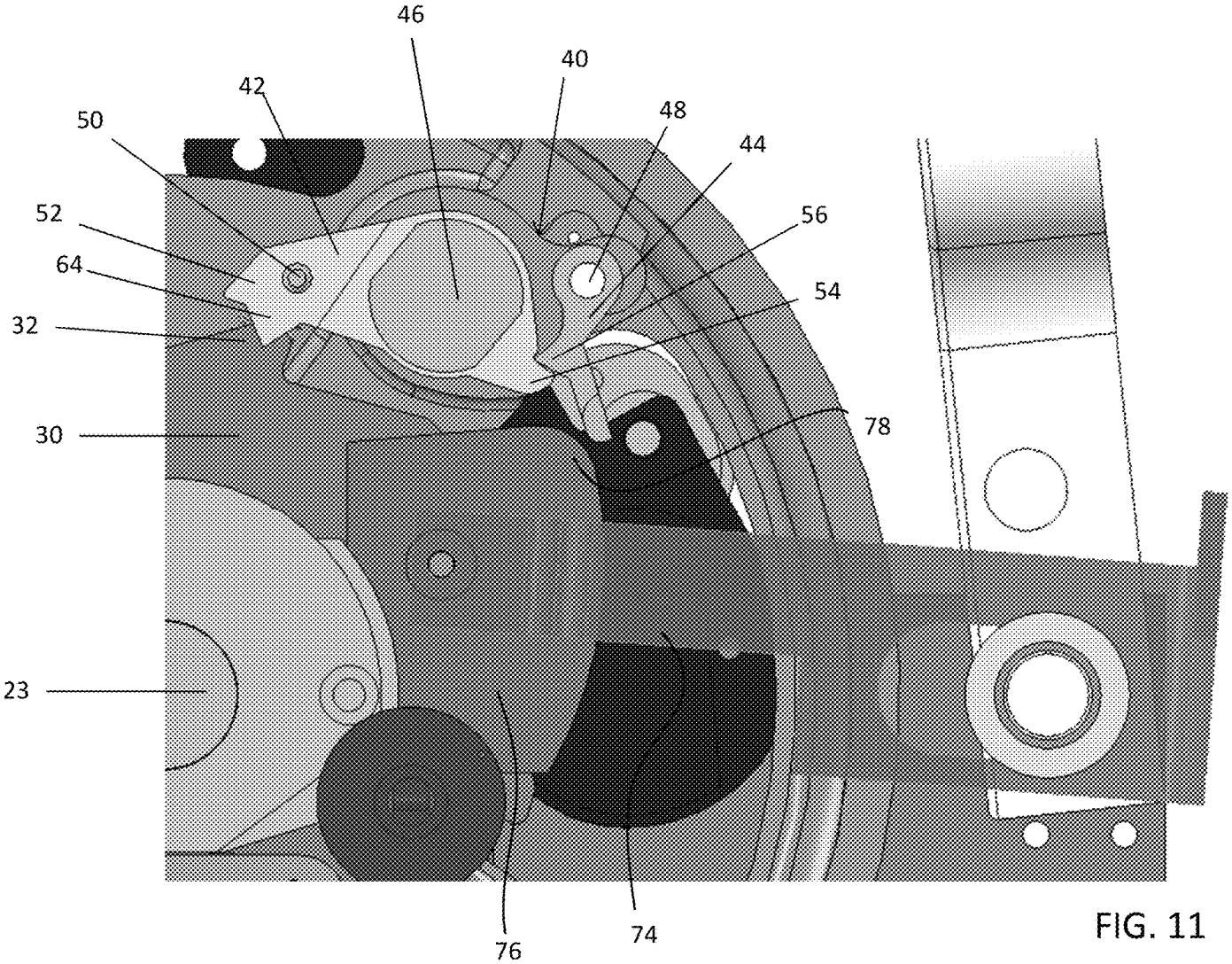
FIG. 11 is a front view of the remote tripping assembly of FIG. 9 in a non-actuated position according to an embodiment.
Figure 12:
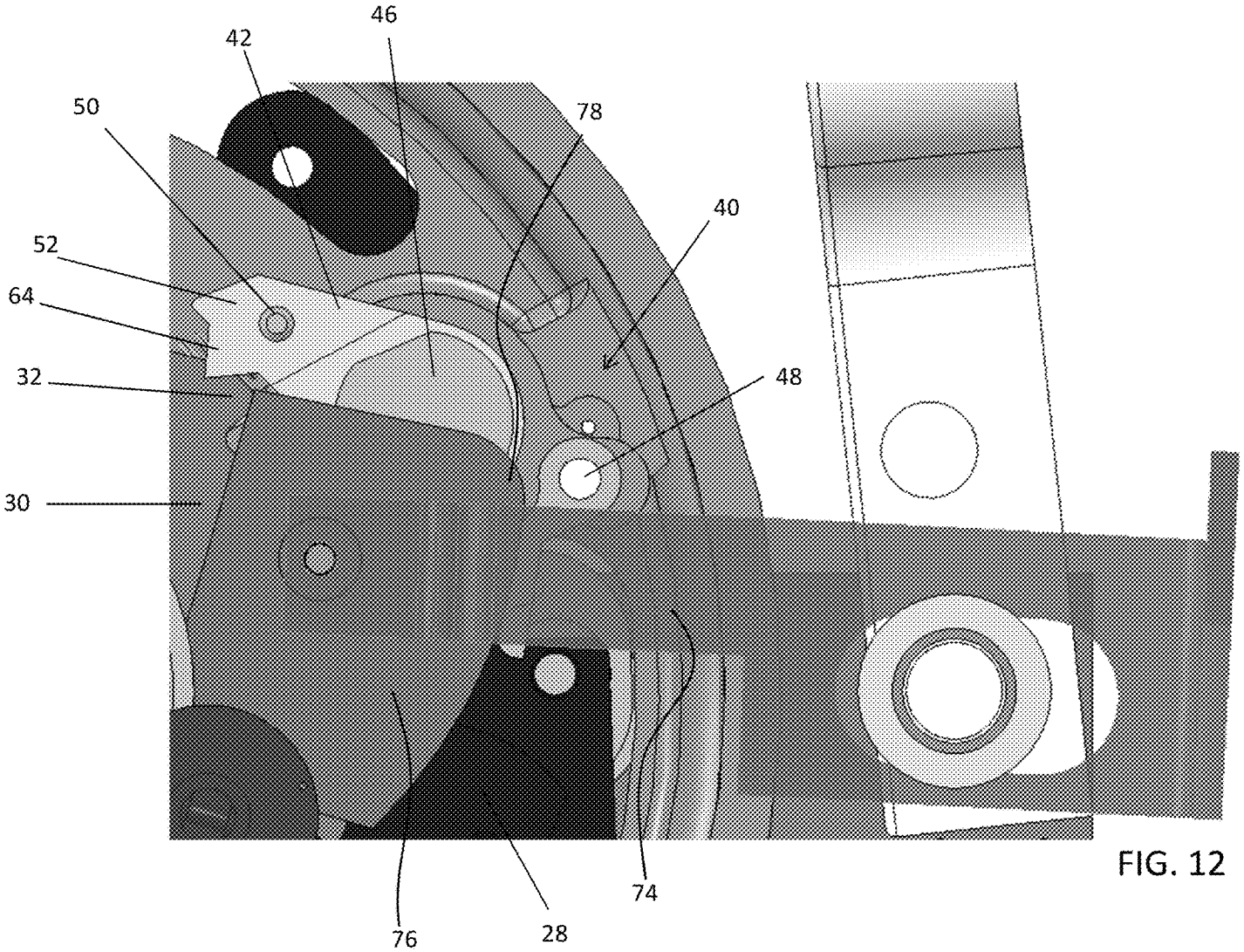
FIG. 12 is a front view of the remote tripping assembly of FIG. 9 at the start of movement of the tripping lever according to an embodiment.

In another embodiment, illustrated in FIGS. 5-8, the resetting feature includes a tooth 64 extending vertically downward from a portion of the engagement end 52 and having at least one angled surface. In addition, the ratchet disc 30 may include a contact member 66, such as a pin or dowel for example, extending perpendicularly outward, parallel to the sheave shaft, from a surface of the disc 30 (see FIG. 10). As shown in FIGS. 7 and 8, rotation of the tripping sheave 18 in the direction indicated by arrow C moves the angled surface of the tooth 64 into engagement with the contact member 66. The contact between the contact member 66 and the tooth 64 drives rotation of the swing jaw 42 about pin 46 in a direction against the biasing force of the biasing member 50 until the shoulder 54 rotates out of contact with the protrusion 56 of the tripping lever 44. As a result, the biasing force of the flyweight biasing mechanism 29 will cause the tripping lever 44 to pivot back to its default position with the protrusion 54 arranged in contact with the upper surface 58 of the shoulder 54 to restrict rotation of the swing jaw 42. The embodiments of contact between the resetting feature and a portion of the ratchet disc 30 are given as examples only, and other configurations designed to drive rotation of the swing jaw 42 about pivot 46 via engagement between the swing jaw 42 and a portion of the ratchet disc 30 are within the scope of the disclosure.

Figure 2A:
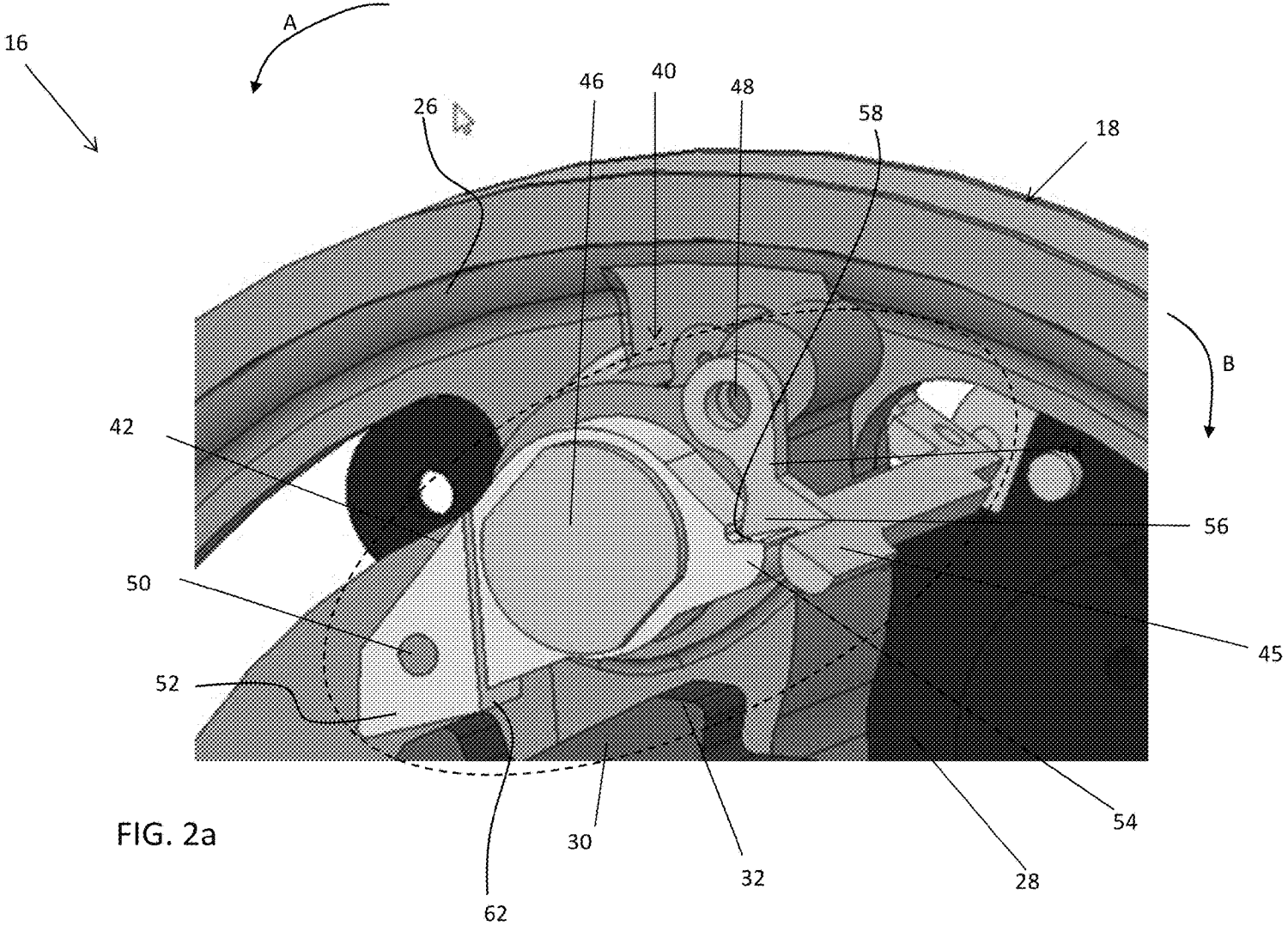
FIG. 2*a* is an isometric view of the tripping sheave and overspeed assembly of FIG. 2 according to an embodiment.

Alternatively, or in addition, a remote tripping assembly 70 may be operably coupled to the overspeed assembly 40. With reference now to FIGS. 9-12, the remote tripping assembly 70 includes an actuator 72, such as a solenoid for example, having an ability to displace a movable member 74 operably connected there to. In the illustrated, non-limiting embodiment, the movable member 74 is configured to slide relative to the actuator. However, other types of movable mechanism, such as a rotatable member for example, are also contemplated. Movement of the movable member 74 via actuator 72 is configured to rotate the tripping lever 44 about pin 48 as previously described to release the swing jaw 42. In some embodiments, a portion 45 of the tripping lever 44 (best shown in FIG. 2*a*) may extend perpendicular to the side surface 26 for cooperation with the movable member 74.

In operation, power is applied to the actuator 72 in response to a signal, indicating that tripping of the governor is desired for any of a variety of reasons, including but not limited to demonstration of tripping operation for an inspection authority for example. The application of power causes the movable member 74 operably coupled to the actuator 72 to move, such as slide linearly for example, relative to the tripping lever 44. In the illustrated, non-limiting embodiment, a contactor 76 having a cam surface 78 is kinematically connected to the movable member 74. However, in other embodiments, the cam surface 78 may be integrally formed with a portion of the movable member 74. As the movable member 74 slides, the contactor 76 and cam surface 78 move into contact with and rotate the tripping lever 44. The remote tripping assembly 70 illustrated and described herein is intended as an example only. Any configuration of a remote tripping assembly capable of rotating the tripping lever 44 is within the scope of the disclosure.

A governor assembly 16 including the automatically resettable overspeed assembly 40 described herein provides efficient and effective engagement between the swing jaw 42 and the ratchet disc 30 upon detection of an overspeed condition. As a result, the time required to stop the elevator car during an overspeed condition may be reduced.

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

What is claimed is:

1. A governor assembly, comprising:

a sheave rotatably mounted on a shaft;

a flyweight mounted to the sheave, the flyweight being movable between a retracted position and an extended position in response to an overspeed condition of the sheave; and an overspeed assembly including:

a swing jaw mounted to the sheave movable between a normal position and a tripped position, the swing jaw being biased into the tripped position; and a tripping lever pivotally mounted to the sheave and configured to cooperate with the swing jaw, wherein the tripping lever is coupled to the flyweight and in response to movement of the flyweight from the retracted position to the extended position, the swing jaw is transformed to the tripped position;

wherein when the swing jaw is in the tripped position, rotation of the sheave in a first direction is restricted, and rotation of the sheave in a second, opposite direction is configured to automatically move the swing jaw against its bias from the tripped position to the normal position.

2. The governor assembly according to claim 1, wherein a biasing mechanism coupled to the swing jaw is configured to bias the swing jaw into the tripped position.

3. The governor assembly according to claim 1, wherein the swing jaw includes a shoulder and the tripping lever includes a protrusion, and during normal operation, the protrusion is arranged in contact with the shoulder to oppose the bias of the swing jaw.

4. The governor assembly according to claim 1, further comprising a ratchet disc mounted on the shaft such that rotation of the ratchet disc is restricted, wherein the swing jaw includes an engagement end and when the swing jaw is in the tripped position, the engagement end contacts the ratchet disc to restrict rotation of the sheave.

5. The governor assembly according to claim 4, wherein the engagement end includes a resetting feature and movement of the sheave in the second direction causes the resetting feature to contact a portion of the ratchet disc and rotate the swing jaw opposite its bias.

6. The governor assembly according to claim 5, wherein the resetting feature is a lip.

7. The governor assembly according to claim 5, wherein the resetting feature is a tooth having an angled surface.

8. The governor assembly according to claim 7, wherein the ratchet disc includes a contact member extending perpendicularly from a surface thereof, the contact member being configured to contact the resetting feature of the swing jaw.

9. The governor assembly according to claim 4, wherein the ratchet disc includes a plurality of teeth extending about a periphery of the ratchet disc.

10. The governor assembly according to claim 1, wherein the tripping lever is operably coupled to the at least one flyweight such that movement of the at least one flyweight to an extended position causes the tripping lever to rotate out of contact with the swing jaw.

11. The governor assembly according to claim 1, wherein a biasing mechanism biases the flyweight to the retracted position, the biasing mechanism being configured to bias the tripping lever into engagement with the swing jaw.

12. The governor assembly according to claim 1, further comprising a remote tripping assembly operably coupled to the tripping lever, the remote tripping assembly being configured to rotate the tripping lever out of contact with the swing jaw.

13. The governor assembly according to claim 12, wherein the remote tripping assembly includes:

an actuator; and a movable member operably connected to the actuator, wherein operation of the actuator moves the movable member relative to the tripping assembly.

14. The governor assembly according to claim 1, wherein the governor assembly is a part of an elevator system, the elevator system including:

an elevator hoistway;

an elevator car movable along at least one car guide rail within said hoistway, the sheave being operably coupled to the elevator car;

a counterweight movable along at least one counterweight guide rail within said hoistway; and at least one tension member operably coupling the car and the counterweight.

* * * * *